US005539707A

United States Patent [19]

Wood

[11] Patent Number: 5,539,707

[45] Date of Patent: Jul. 23, 1996

[54] ELECTROLUMINESCENT LAMP DRIVER SYSTEM

[75] Inventor: Grady M. Wood, Melbourne, Fla.

[73] Assignee: Harris Corporation, Melbourne, Fla.

[21] Appl. No.: 490,952

[22] Filed: Jun. 15, 1995

[51] Int. Cl.[6] ..... G04B 19/30; G09G 3/10; G09G 3/36

[52] U.S. Cl. ..... 368/67; 368/227; 315/169.3; 345/102

[58] Field of Search ..... 368/67, 226, 227; 315/169.3; 345/76, 102

[56] References Cited

U.S. PATENT DOCUMENTS

| | | | |
|---|---|---|---|
| 4,527,096 | 7/1985 | Kindlmann . | |
| 4,995,016 | 2/1991 | Watanase | 368/67 |
| 5,093,612 | 3/1992 | Herold | 323/222 |
| 5,265,071 | 11/1993 | Thorgersen et al. | 368/67 |
| 5,313,141 | 5/1994 | Kimball . | |
| 5,339,294 | 8/1994 | Rodgers | 368/67 |
| 5,347,198 | 9/1994 | Kimball . | |
| 5,384,577 | 1/1995 | McLaughlin et al. | 345/102 |

*Primary Examiner*—Vit W. Miska
*Attorney, Agent, or Firm*—Nixon, Hargrave, Devans & Doyle

[57] ABSTRACT

An electroluminescent lamp driver system for driving or powering an electroluminescent lamp to illuminate the display in an electronic watch, such as a quartz analog watch, uses the counter in a CMOS timekeeping chip which counts down the quartz oscillator frequency to one Hz for an analog quartz watch. The counter provides a plurality of pulse trains which are combined in digital logic to provide switching signals. The digital logic is included in the timekeeping chip and is implemented in low voltage bulk CMOS. A high voltage is required to drive the lamp and it is provided in a separate chip containing a high voltage inverter in which current is switch through an inductor in response to the switching signals from the timekeeping chip. The efficiency of the inverter is improved by generating, in the timekeeping chip, switching signals in the form of pulse trains which are asymmetric and have a duty cycle of greater than 50% to operate the switch when the output voltage from the bridge is in one-half of the AC output voltage across the lamp (the capacitance of the lamp is being charged) and has a duty cycle of less than 50% during the second half of the AC cycle when the capacitance of the lamp is being discharged. The system architecture segregates the high voltage and low voltage circuitry, eliminates redundant elements (a separate low frequency oscillator) and the digital logic for providing the pulse trains which produce switching in the inverter is located in the timekeeping chip where it may be implemented at lower cost than in the high voltage inverter chip.

13 Claims, 7 Drawing Sheets

CMOS-TIME KEEPING CHIP-30
XTAL
OSC 32,768 Hz (CMOS)
81
B+
D1
Z
8928.5 Hz, DGC1490
90
91
NAND
B+
D2= D1/2
1.5 STAGE RIPPLE COUNTER (CMOS)
80
82
D8= D1/8
128 Hz DC 1:1 (50%)
Ā
INV
94
B+
60
BUFFER
83
WATCH TIME DISPLAY
90
X
92
93
Y
A
40-HV CHIP
HV INVERTER 3 TERMINAL
LD
11 E
50-HV CHIP
HV INVERTER BRIDGE
11

LAMP
11
40
+BATTERY
L
F
G
H
30
TIME KEEPING CHIP
NOR
NOR
NOR
AND
86
INV
INV
+BATTERY
LIGHT-ENABLE SWITCH
CRYSTAL
81
32.768 OSC
A
B
C
D
1-STAGE COUNTER
1-STAGE COUNTER
6-STAGE COUNTER
BUFFER
83
E
OUTPUT TO WATCH
80
82
FREQUENCY
A=32,768
B=16,384
C=8,192
D=128
E=1

ELECTROLUMINESCENT LAMP DRIVER SYSTEM

DESCRIPTION

The present invention relates a system for driving an electroluminescent lamp, which utilizes the timekeeping circuitry of an electronic watch and illuminates the watch display. More particularly, the invention provides a system of circuits for an electronic watch having a high voltage operated lamp, such as an electroluminescent lamp, and wherein the high voltage is provided by one of the circuits with components capable of handling the high voltage and the other circuit contains the timing oscillator and all of the digital circuitry of the watch which generate the signals for the circuit providing the high voltage.

The invention is especially suitable for providing an electronic watch with an electroluminescent lamp with a two-chip architecture, one chip containing time keeping circuits and being implemented in low voltage bulk CMOS and the other chip containing an inverter circuit operative at higher voltage for lamp driving (typically greater than a hundred volts AC, peak to peak) which is operated by switching signals generated in the timekeeping chip. Both the timekeeping chip and the high voltage inverter chip may be operated by the same low voltage battery (such as a 1 to 3 volt miniature watch battery).

Electroluminescent lamp driving inverter circuits are shown in U.S. Pat. No. 5,313,141 issued May 17, 1994 to R. A. Kimball. The electroluminescent lamp is used in miniature devices such as pagers and wrist watches for display illumination purposes. Such miniature devices use very low voltage (1 to 3 volt) batteries and the inverter circuits are required to provide high voltage which is of sufficient amplitude for operating the lamp, for example, about 100 volts peak to peak AC voltage. Such inverter circuits may also be of the H-bridge type such as shown in Kindlmann, U.S. Pat. No. 4,527,096 issued Jul. 2, 1985.

In electronic watches, quartz oscillators provide a frequency accurate output which is divided down by a counter to provide timing signals. These timing signals may be one Hz for operating the timing device of quartz analog watches. Multiple counter outputs are used to operate the display of quartz digital watches. The oscillator (except for the quartz timing crystal), the counter and other digital circuitry are conventionally implemented in a low voltage integrated circuit chip. A separate chip using at least one oscillator and digital logic to generate switching signals and the components of the inverter are part of a separate chip capable of high voltage operation. The timekeeping chip is typically implemented in low voltage bulk CMOS which allows very dense packing of components for a high level of integration in a very small space. On the other hand, the inverter chip is fabricated with high voltage elements which are required to handle the high voltages (typically greater than a hundred volts peak to peak AC) which are needed to operate the lamp. In some systems, the voltage swing at the output of the inverter often exceeds both the voltage supply rail and the ground rail. In such systems, the high voltage chip requires passive isolation in the fabrication thereof. These high voltage and passive isolation requirements require the high voltage inverter circuit to be implemented in techniques where these elements are not as densely packed and, therefore, are more expensive than, the low voltage bulk CMOS timekeeping chips.

It is the principal object of the present invention to provide an improved system and architecture for the electroluminescent lamp driver circuitry and timekeeping circuitry of an electronic watch or other miniature device which utilizes an oscillator and counter chain, such devices are referred to as electronic timekeeping systems herein and include without limitation analog and digital watches and other devices which utilize an oscillator and counter chain.

In accordance with an aspect of this invention, the digital circuitry which provides the switching signals for the inverter are all contained in one circuit which is preferably implemented in low voltage bulk CMOS. The high voltage circuits which constitute the inverter are contained in another circuit, which may be implemented as another integrated circuit chip, having the inductor of the inverter and the lamp outboard of the inverter chip, but connected thereto.

In accordance with another aspect of the invention, the efficiency of the system may be increased by operating the inverter over a shorter time to discharge the energy stored in the inductor and a longer time to charge energy into the inductor. The digital circuitry implemented in the low voltage circuit includes, when such increase in efficiency is desired, logic for combining output from different stages of the counter so as to obtain asymmetric pulse trains. Then, on the half cycle of the AC output voltage from the inverter, when the voltage in the capacitance of the lamp is being charged, the duty cycle of the switching pulses is greater than 50%. On the half cycle when the capacitance of the lamp is being discharged (charged to a voltage below ground) the duty cycle is more than 50%.

DRAWINGS

The foregoing and other objects, features and advantages of the invention will become more apparent from a reading of the following description in connection with the accompanying drawings in which.

Figure 1:
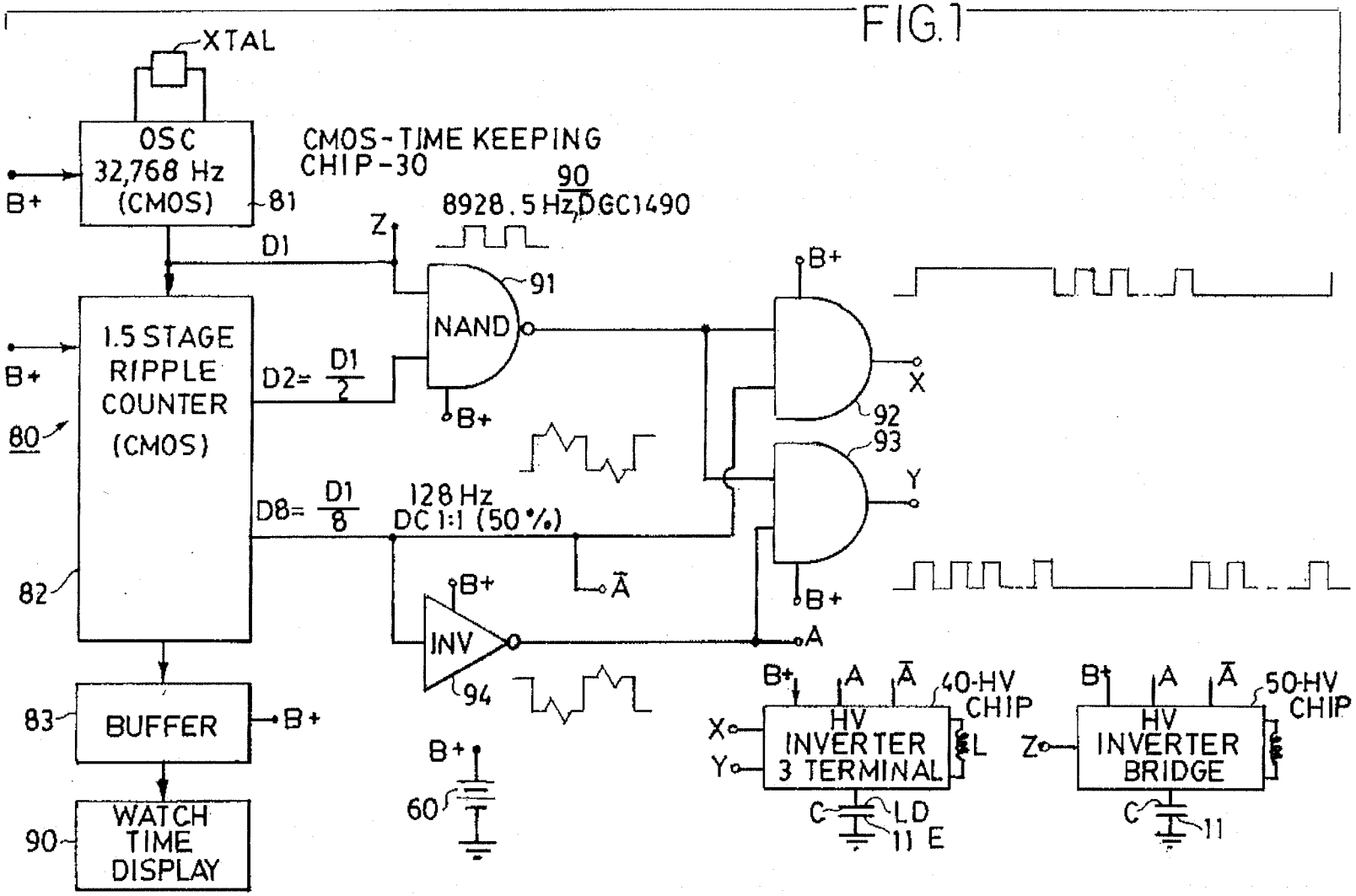
FIG. 1 is a block diagram illustrating the system and system architecture in accordance with the invention wherein different bipolar, high voltage inverter chips may be used, one being a three-terminal switch such as shown in the Kimball patent and the other being a bridge inverter as shown in the Kindlmann patent.
Figure 6:
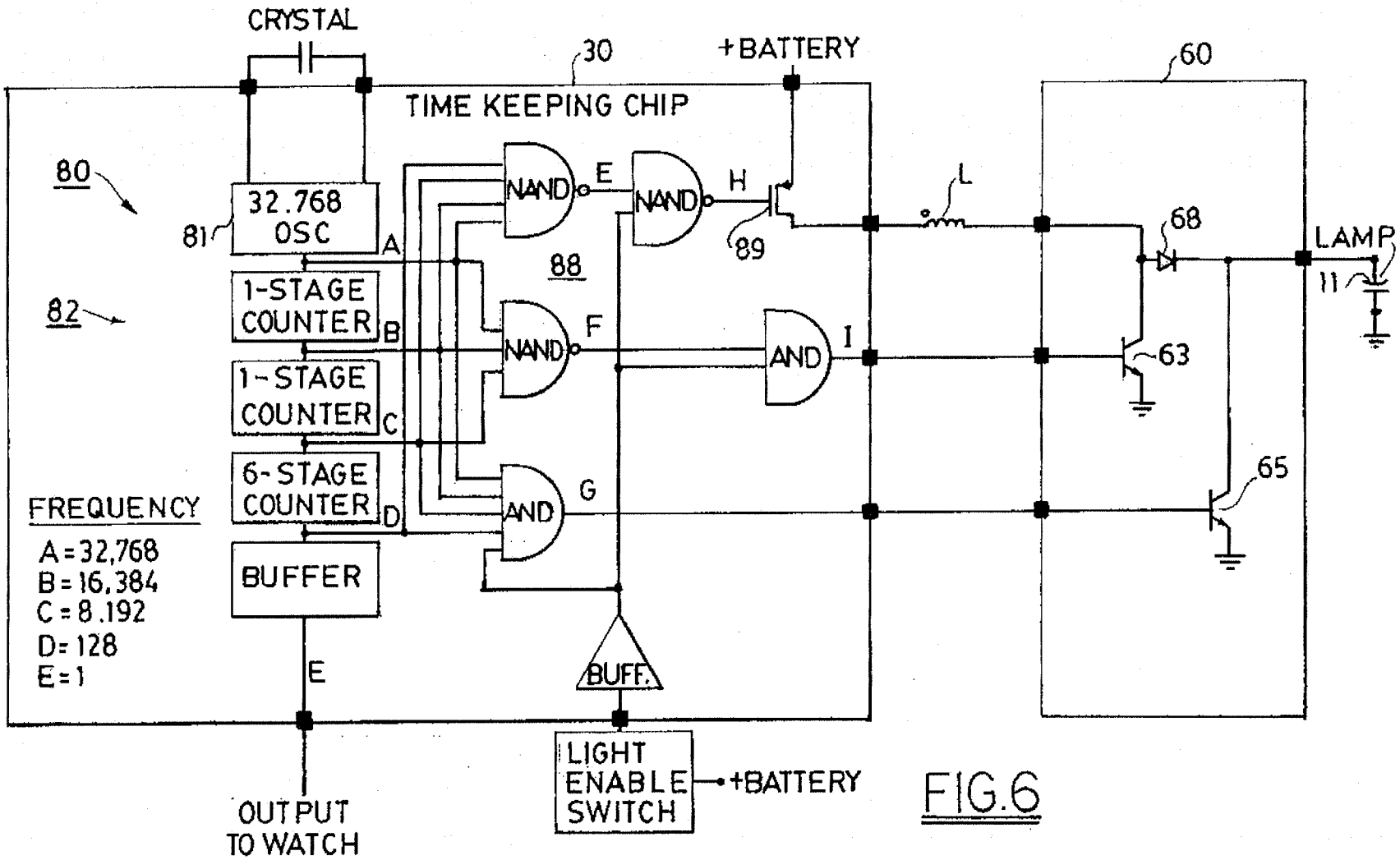
Figure 7:
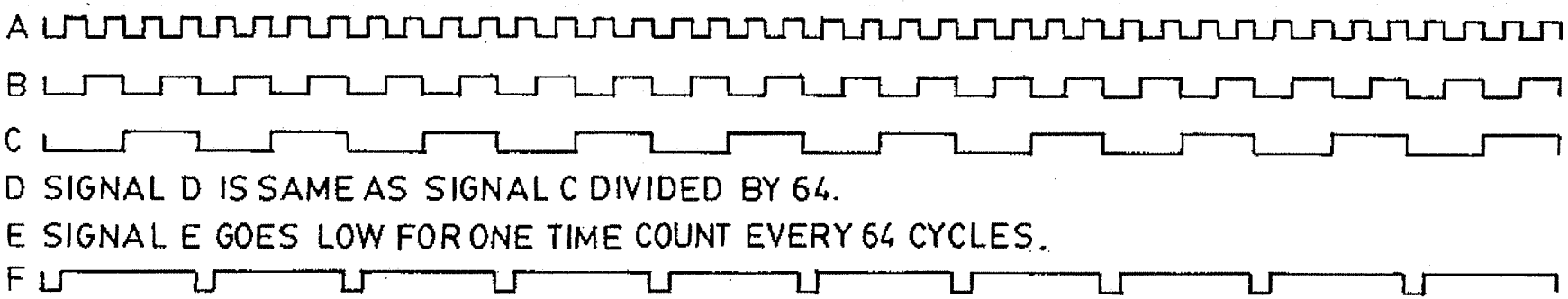

FIG. 6 is a circuit diagram for the system architecture shown on FIG. 1 where the high voltage chip 60 is a single ended circuit with switching transistors for charging and discharging the electroluminescent lamp load are unipolar transistors 63 and 65;

FIG. 7 is a set of timing diagrams for pulse trains A–I appearing on FIG. 6

DETAILED DESCRIPTION

Referring to FIG. 1, there is shown a timekeeping circuit implemented on an integrated circuit chip 30 and two bipolar, high voltage inverter circuits 40 and 50, which may be implemented on separate chips. One of these circuits 40 and 50 is used in the system. The circuit 40 is like the inverter circuit shown in FIG. 6 of the above-referenced Kimball patent. The circuit 50 is an inverter bridge of the type shown in the above referenced Kindlmann patent. Both the timekeeping chip 30 and the inverter chip 40 or 50 is powered by the same supply which is illustrated as a battery 60 which may be a 1 to 3 volt watch battery.

The timekeeping circuitry is illustrated together with a watch time display 70, which is not on the chip 30 but is connected thereto. The display is an analog time display and the watch using the chips 30, 40 or 50, battery 60 and display 70 may be an analog quartz watch.

Quartz stable frequency timing is provided by a timing chain 80 having a quartz crystal (XTAL) controlled oscillator 81, a 15-stage ripple counter 82, a buffer such as an inverter stage 83, all of which are connected in tandem to the display 70.

Digital logic circuits 90 utilize pulse train outputs from the oscillator, $D_1$ and outputs from the first and eighth stage of the counter 82 ($D_2$ and $D_8$). $D_2$ is at half the frequency or rate of $D_1$ which is the oscillator frequency (32.768 KHZ). $D_8$ is one-eighth $D_1$ or approximately 128 Hz.

The logic includes a NANDgate 91 two ANDgates 92 and 93 and an level inverter 94. The logic circuit 90 is generic to, and may be used with, either the three-terminal inverter 40 or the bridge inverter 50. The switching and timing control input to these inverters are illustrated by like letters X,Y,Z, and $\overline{A}$. The input Z may be a relay or transistor switch which switches current through the inductor at the high frequency rate $D_1$.

A nonsymmetrical duty cycle switching pulse is obtained by combining the output of the NANDgate 91, the $D_8$ output, and the inverted version thereof in the ANDgates 93. The wave forms which appear for the switching signals X and Y are shown adjacent to these input terminals. During the Y switching signal, when the load (the electroluminescent lamp 11 having a capacitance C is being charged) the X input pulse train bar a duty cycle of is preferably approximately 7 to 1 or 14% as shown in the 8928.5 Hz pulse train at the output of the NANDgate 91. This pulse train is effectively inverted in the ANDgate 92 to provide the switching signal X which is operative during the discharge half cycle of the capacitance C. The efficiency increase with results from the discharge of the inductor L over a shorter time than the charge thereof will be more apparent from the following discussion.

When the inductor L is being discharged, it is essentially in parallel with the load capacitance. The required discharge time is ¼ of the period of the resonate frequency formed by these two elements. The resonate frequency in cycles can be calculated from the following equation.

$$F_o = \frac{1}{2\pi\sqrt{LC}}$$

If the discharge window is longer than this time, then time is wasted and distracts from the efficiency. If the time is too short than the inductor is not fully discharged.

When the switches are closed and a voltage is applied to the inductor the current starts to increase approximately linearly (if inductor series resistance is low) until the on cycle is ended. The current at the end of the on cycle can be expressed by the following equation.

$$ip = V/R[1-\exp(Ton(R/L))]$$

Where:

ip=peak current

R=the total resistance in the charging circuit (primarily the sum of the collector resistor of the NPN and PNP output transistors and the resistance of the inductor)

Ton=the on time

The energy can be expressed as:

$$e = I^2L/2$$

In order to pick the most efficient ratio of on to off time, the inductor value and load value as well as the supply volute and switch impedance must be considered.

For typical watch application requiring a 1 square inch lamp with a typical capacitance of 3 nF. operating from a 1.5 V supply, ratios of approximately 7 to 1 have proven to provide high efficiency with a reasonable peak currents.

The asymmetrical signal, which is presently preferred, produces a charge time of approximately 107 microseconds and a discharge time of approximately 15 microseconds. This charging and discharging occurs during the half cycle of charging and half cycle of discharging of the capacitance C presented by the lamp 11.

All of the circuitry of the timekeeping chip 30 is preferably implemented in CMOS using low voltage bulk CMOS technology. The high voltage inverter 40 is implemented with passive isolation in an integrated circuit chip and with components, switching transistors and diodes which can take reverse voltages greater than present in the chip (over about 100 volts peak to peak).

Figure 2:
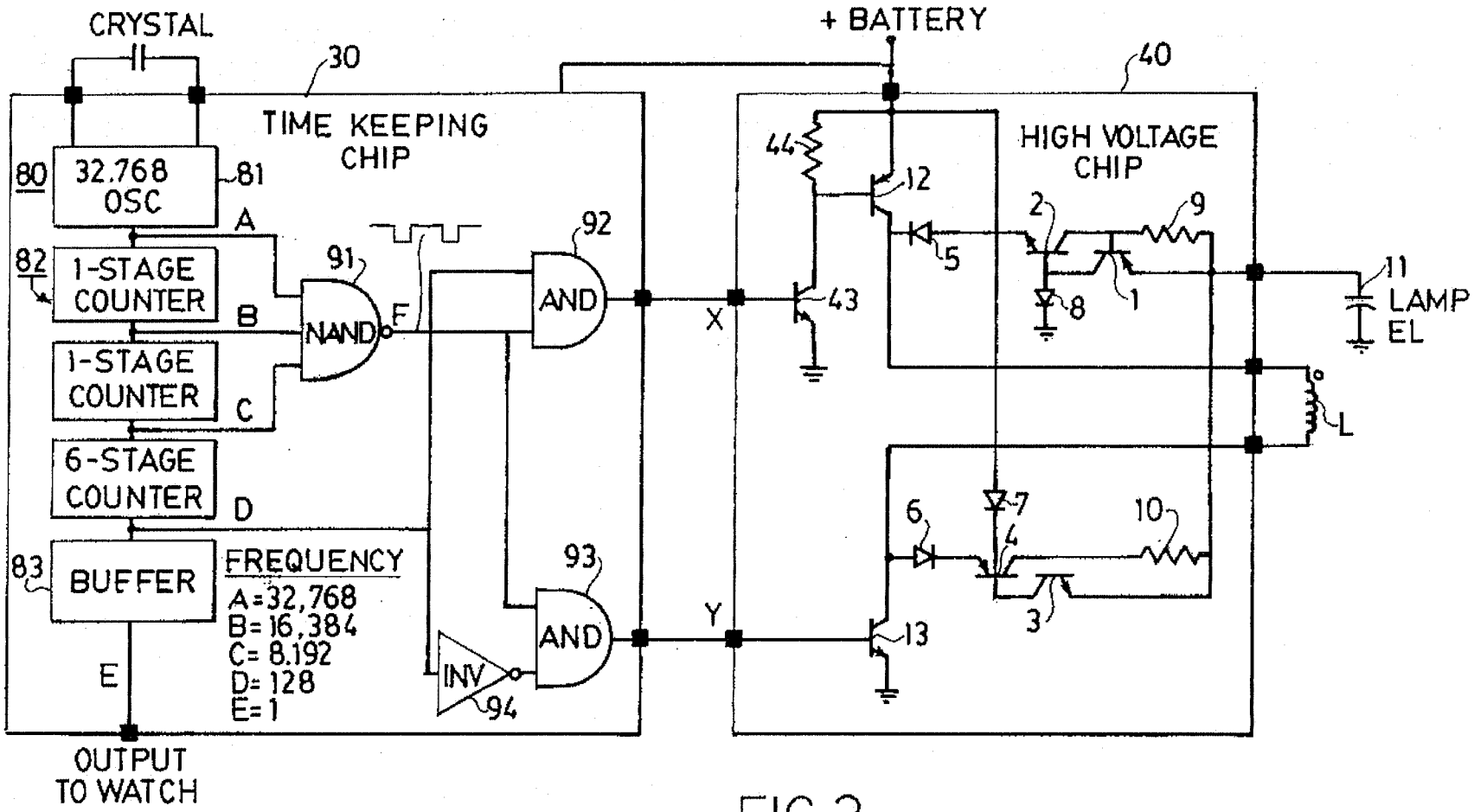
FIG. 2 is a more detailed circuit diagram of the system and architecture shown in FIG. 1 where the high voltage inverter chip utilizes an improved automatic triggering circuit requiring only two switching signals, such an inverter circuit being the subject matter of another application filed in the name of the same inventer as this application and concurrently therewith.
Figure 3:
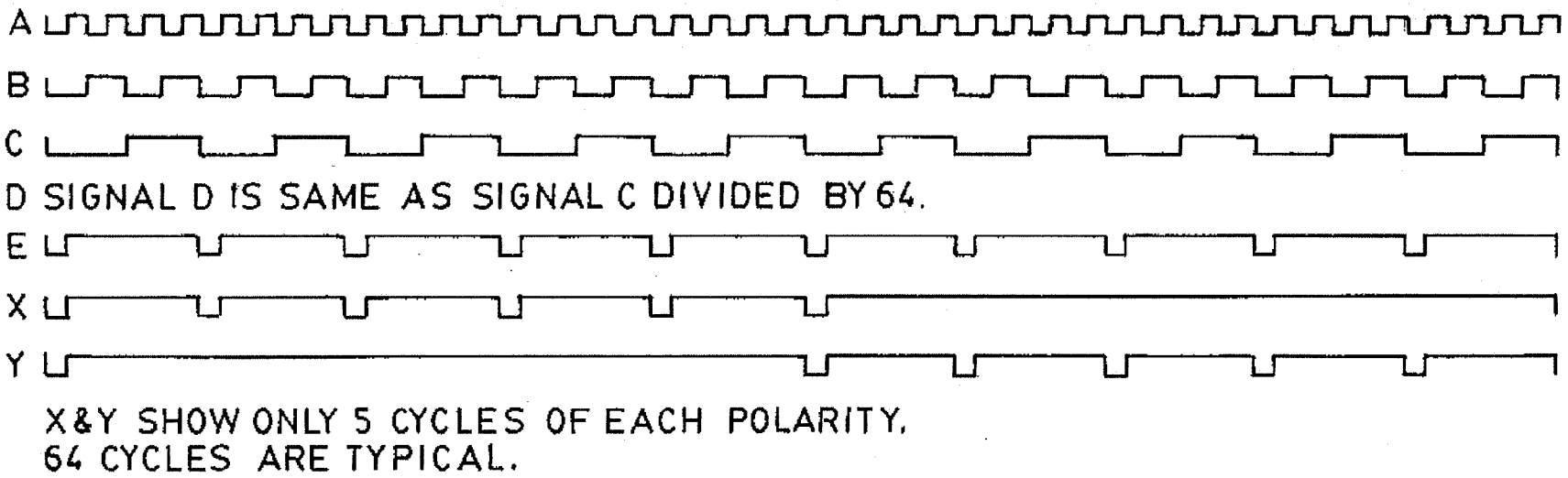
FIG. 3 is a set of timing diagrams for pulse trains A–E, X and Y appearing on FIG. 2.

Referring to FIG. 2, there is shown the timekeeping chip 30 and the high voltage inverter chip 40. The counter 82 is an eight-stage counter having output frequencies indicated at A, B, C, D and E. The NANDgate 91 combines outputs A, B and C to produce the nonsymmetrical 1 to 7 duty cycle pulse train F. These pulse trains are shown, idealized, (without noise or distortion), in FIG.3. Note than only 5 cycles of each polarity are shown on X and Y. Sixty-four (64) cycles may suitably be used in a practical circuit.

The high voltage chip 40 has an additional triggering stage for one of the switching transistors 12 provided by a resistor 44 and a PNP transistor 43 connected between the supply side (plus battery) and the return side of the battery (ground). The output switching transistors 1, 2 and 3, 4 may be SCRs. This circuitry is described in the above referenced patent application filed by the inventor hereof.

Briefly, the operation of the inverter circuit 40 is as follows:

First consider the half cycle of the AC output voltage across the load 11 where the load is charged negatively with respect to ground. NPN switching transistor 13 is turned on by the negative pulses occurring during half cycle at input X. Transistor switch 12 and transistor switch 13 are both on and the current through the inductor L starts to increase. This current is interrupted at the onset of the pulse switching transistor 12 off. The voltage at the upper terminal (marked with the dot in the drawing) exhibits an transient or spike in the negative direction. This voltage spike causes diode 5 to be forward biased. The capacitance formed at the base of transistor 2 and by the junction of diode 8 is discharged through the base emitter junction of transistor 2. This current sets off a regenerative action between transistors 2 and 1 (i.e. in the four-layer SCR 1, 2) via the feedback resistor 9. Except for the small capacitive discharge current, which starts this regenerative action, all of the current required by the collapsing field in the inductor L is supplied by the capacitive load 11. The triggering occurs and is repeated in synchronism with the spike during each discharge current pulse through the output SCR switch 1, 2. While the load 11 is being discharged, the SCR 3, 4 is held off. The resistor 10 and the junction in transistor 3 prevents transistor 3 (i.e the SCR 3, 4) from being triggered at its cathode gate as the steps of voltage occur, which form the negative half cycle of the voltage across the transistor steps (i.e. during the discharge of the load 11).

During the positive half cycle, while charging current to the lamp is applied in unidirectional pulses, the emitter of transistor 4 receives a positive going spike which causes discharge of the capacitance in the junction of diode 7 and in the base to emitter (gate to trigger) junction of SCR 3, 4. Regenerative action takes place which causes triggering of the SCR 3, 4 in synchronism with the onset of switching in the transistor 13 (in synchronism with the onset of each pulse applied to input Y). Accordingly, the operation during the positive half cycle is generally similar to the operation during the negative half cycle in both cases automatic triggering of the SCRs 1, 2 and 3, 4 occurs.

Figure 4:
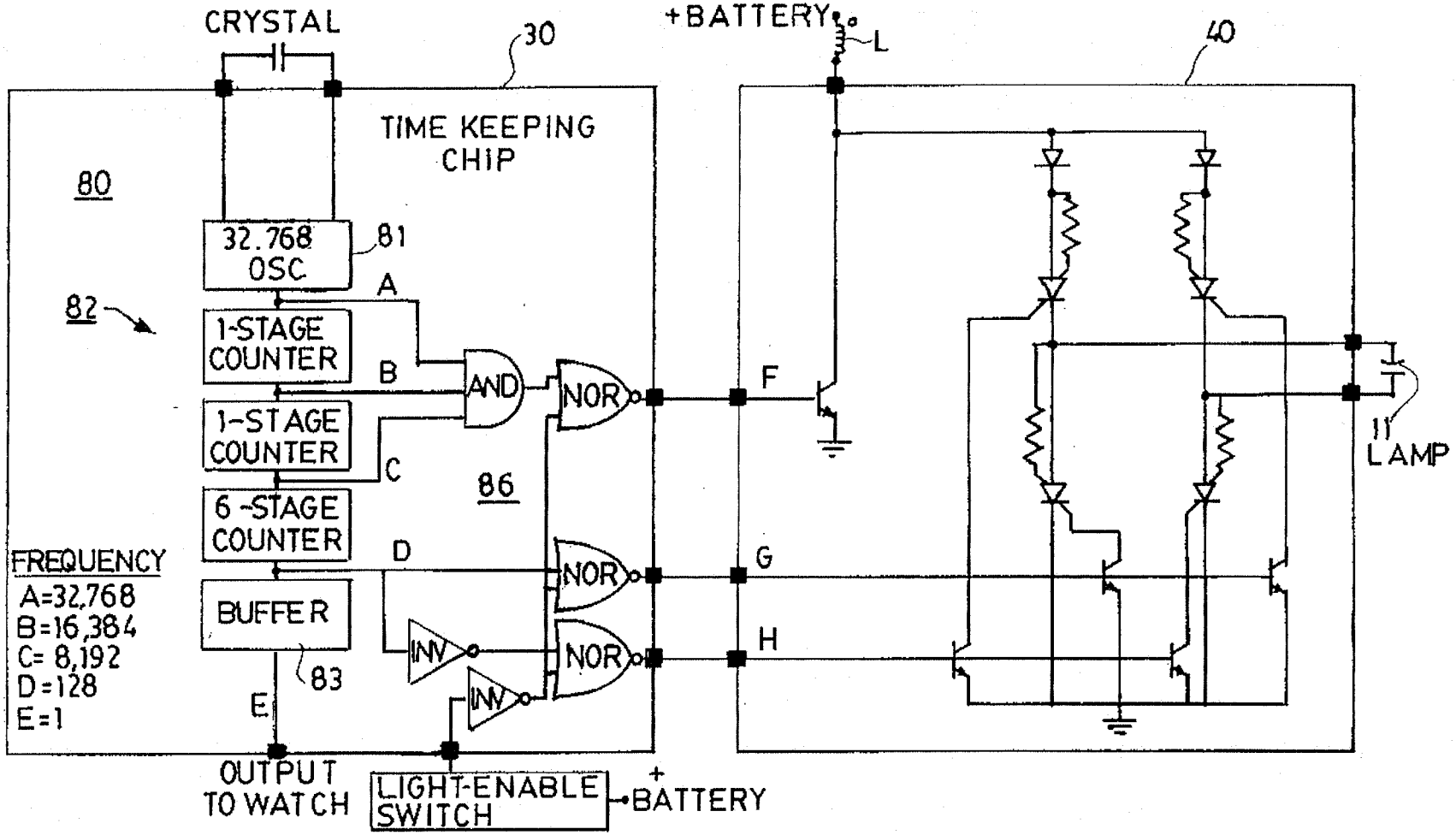
FIG. 4 is a circuit diagram for the system architecture shown in FIG. 1 where the high voltage chip contains a bridge inventer.
Figure 5:
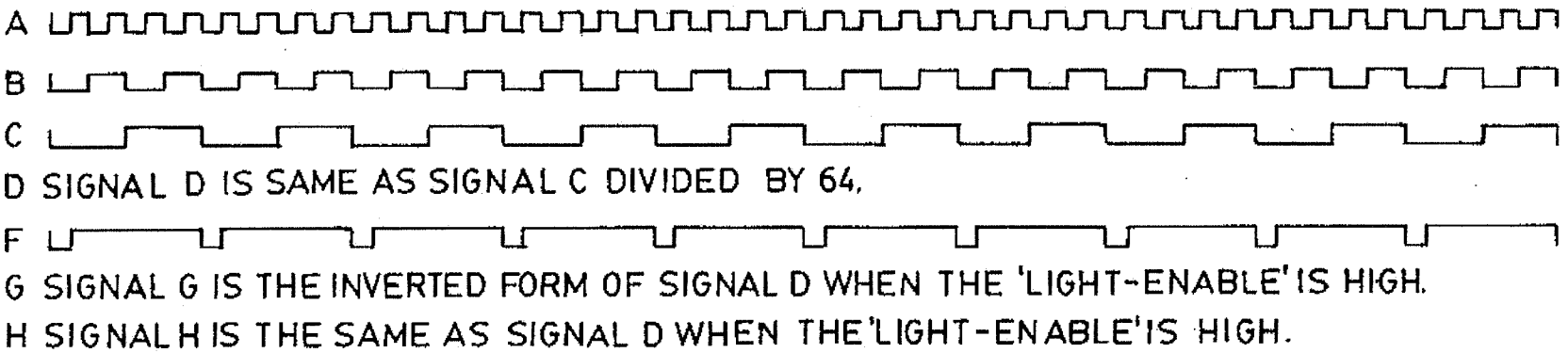
FIG. 5 is a set of timing diagrams for pulse trains A–H appearing on FIG. 4.

FIGS. 4 and 6 show a circuit for bridge and single ended implementation, of the invention. The digital logic on the low voltage CMOS chip (86—FIG. 4 and 88—FIG. 6) are modified to meet the timing needs of the inventer chips. The single ended chip 60—FIG. 6 may alternately be implemented with discrete elements (transistors 63 and 65 and blocking diode 68). The pulses trains A–H for FIG. 4 and A–I for FIG. 6 are shown in FIGS. 5 and 7. The CMOS logic uses a FET 89 to connect the battery to the inductor L except during a single pulse (time out) of train A, which occurs when the lamp 11 is discharged. In other words, the load is pumped positive for 64 cycles and then discharged for one cycle and pumped positive again.

From the foregoing description, it will be apparent that it has been described an approved system and system architecture especially suitable for operating an electroluminescent lamp of an electronic watch. Variations and modifications in the herein described systems, within the scope of the invention, will undoubtedly suggest themselves to those skilled in the art. Accordingly, the foregoing description should be taken as illustrative and not in a limiting sense.

I claim:

1. In an electronic timekeeping system having a time display and an electroluminescent lamp for illuminating said display, a system for operating said display and applying power from a battery and through an inductor to said lamp, which system comprises first and second circuits respectively operative at relatively low and relatively high voltage, said first circuit being operative exclusively at said low voltage, said first circuit having an oscillator, a counter connected to said oscillator for receiving a relatively high frequency first signal therefrom and providing a plurality of second signals, each of successively lower frequency than said first signal, the lowest frequency signal of said plurality of second signals being of frequency for driving said display to keep time, said first circuit also having circuits responsive to at least some of said plurality of second signals for providing switching signals, said second circuit being an inverter having a high voltage output connected to said lamp and at least one switching input for operating means for switching current from said battery in said inductor, and said switching signals being connected to said switching input of said inverter.

2. The system according to claim 1 wherein said first and second circuits are powered by a battery which supplies and low voltage.

3. The system of claim 1 wherein said first circuit contains exclusively CMOS components operative at said low voltage.

4. The system of claim 3 wherein said second circuit contains bipolar components operative at said high voltage.

5. The system of claim 1 wherein said first circuit is a first integrated circuit chip structure and said second circuit is a second integrated chip structure.

6. The system of claim 1 wherein said inverter is a three terminal circuit having a pair of switching inputs and high voltage output, said circuit responsive to said plurality of second signals providing a plurality of said switching signals including first and second switching signals which are connected to said switching inputs, said high voltage output being connected to said lamp.

7. The system of claim 1 wherein said inverter also has a bridge circuit with switching elements and inputs for operating said bridge switching elements, said circuits responsive to said plurality of second signals being connected to said inputs for operating said switching elements of said bridge circuit and applying said switching signals thereto.

8. The system of claim 1 wherein said high voltage output is an AC output having a frequency much lower than said relatively high frequency, said plurality of signals provided by said counter including a first pulse train at a rate equal to said AC output frequency.

9. The system according to claim 7 or wherein said plurality of switching signals provided by said counter includes a second pulse train at a rate between the rate of said pulse train and said relatively high frequency.

10. The system according to claim 9 wherein said high frequency is of the order of 10 KHz and said first pulse train rate is about ⅛ of said high frequency and said second pulse train rate is about ½ of said high frequency.

11. The system of claim 9 wherein said means responsive to said plurality of second signals includes means for combining said first and said second pulse trains to provide a train of asymmetric pulses which provides said switching signal, said train having a duty cycle greater than 50% during ½ of said AC cycle and less than 50% during the other half of said AC cycle.

12. The system according to claim 10 wherein said duty cycle is about 7 to 1, the period of said pulses occurring during said ½ of said AC cycle being 7 times the period of the pulses which occur during said other half of said AC cycle.

13. The system of claim 1 wherein said oscillator, said counter contain active elements which are CMOS elements exclusively, and said circuit responsive to said plurality of second signals are digital logic circuits which also contain active elements which are CMOS elements exclusively, said CMOS elements being the exclusive elements of said oscillator, counter and digital logic circuits and thereby are operative at said low voltage with high efficiency.

* * * * *